United States Patent [19]

Cimochowski

[11] 4,272,638

[45] Jun. 9, 1981

[54] HEATER ELEMENT SUPPORTS FOR USE WITH FIBROUS BLOCK INSULATIONS

[75] Inventor: Anthony E. Cimochowski, Sedalia, Colo.

[73] Assignee: Johns-Manville Corporation, Denver, Colo.

[21] Appl. No.: 21,051

[22] Filed: Mar. 16, 1979

[51] Int. Cl.[3] ..... F27D 11/02; H05B 3/06

[52] U.S. Cl. ..... 13/25; 219/390

[58] Field of Search ..... 13/25, 20, 22, 35; 219/390; 432/247; 266/286

[56] References Cited

U.S. PATENT DOCUMENTS

| | | | |
|---|---|---|---|
| 1,768,865 | 7/1930 | Smalley . | |
| 2,591,723 | 4/1952 | Sampson . | |
| 3,368,802 | 2/1968 | Morgan et al. . | |
| 3,523,395 | 8/1970 | Rutter et al. . | |
| 3,705,253 | 12/1972 | Hicks . | |
| 3,738,217 | 6/1973 | Walker . | |
| 3,819,468 | 6/1974 | Sauder et al. . | |
| 3,832,815 | 9/1974 | Baloz et al. . | |
| 3,952,470 | 4/1976 | Byrd . | |
| 3,987,237 | 10/1976 | Phillips et al. . | |
| 4,001,996 | 1/1977 | Byrd . | |
| 4,011,394 | 3/1977 | Shelley | 13/25 |
| 4,018,023 | 4/1977 | Anderson . | |
| 4,088,825 | 5/1978 | Carr | 13/25 |
| 4,154,975 | 5/1979 | Sauder | 13/25 |

OTHER PUBLICATIONS

"Pyro-Bloc" Brochure No. 8-77-5m (1977).
Johns-Manville Brochure No. IND-3329 (1977).
Johns-Manville Brochure No. IND-3330 (1977).

*Primary Examiner*—Roy N. Envall, Jr.
*Attorney, Agent, or Firm*—Robert M. Krone; Joseph J. Kelly

[57] ABSTRACT

A device is described for support of electrical heater elements in a furnace thermally insulated by blocks of fibrous insulation and heated by the electrical heater elements. The device comprises a bar shaped member disposed at the hot face of the block and having element support means therewith, the member being releasably secured in position by securing means integral with the block.

34 Claims, 19 Drawing Figures

80
76
2
26
54a
78
40
46a
72
48
8
60a
66a
74
70

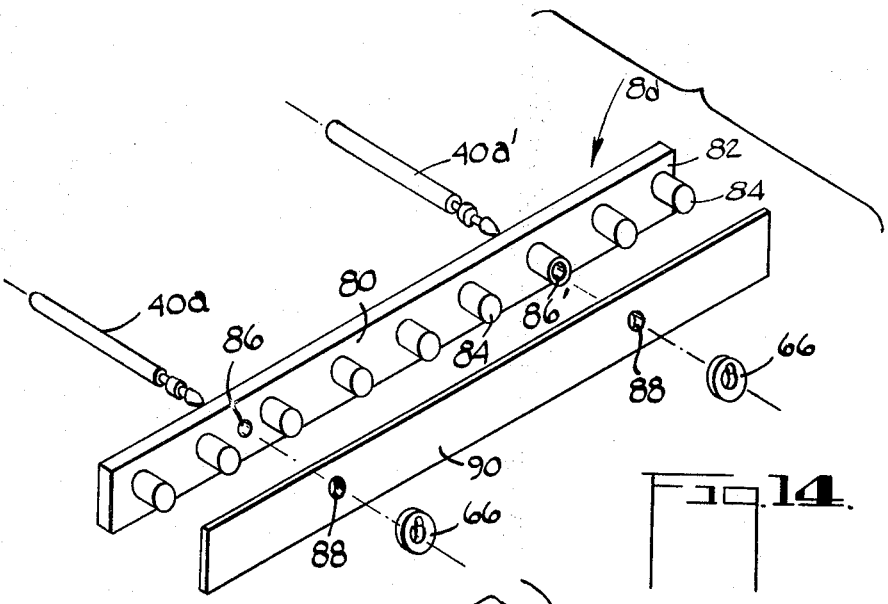
FIG. 14.
FIG. 15
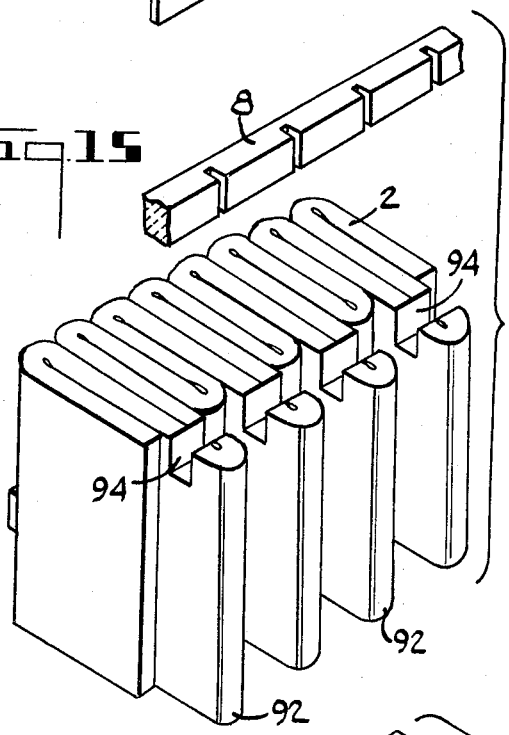
FIG. 16.
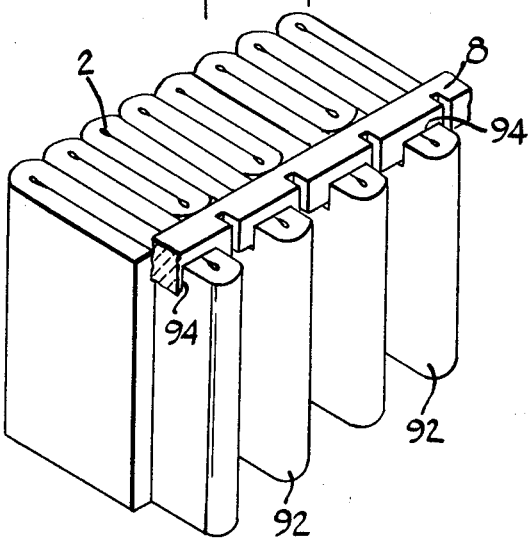
FIG. 17.
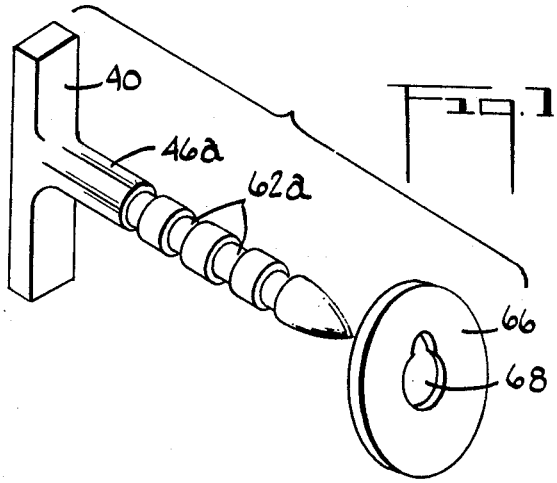

HEATER ELEMENT SUPPORTS FOR USE WITH FIBROUS BLOCK INSULATIONS

TECHNICAL FIELD

The invention herein relates to fibrous block insulations. More particularly, it relates to systems for using such insulations in electrically heated furnaces.

BACKGROUND OF PRIOR ART

The use of refractory fiber block insulations as thermal insulating liners for various types of ovens, kilns and furnaces (particularly those used for annealing of articles such as glassware of firing of materials such as clay products) has become quite widespread in industry. These block insulations are lightweight, highly resistant to thermal shock, have very low heat holding capacities, and are readily installed and easily removed for repair or replacement. Generally the blocks are formed from refractory fiber blankets or batts, either by cutting the blankets or batts into small sections and placing these sections against one another to form the block, or by folding lengths of blankets into blocks. Each block commonly has width and breadth dimensions of approximately 1 ft. (30 cm) each with a depth in the range of from 4 to 12 in. (10 to 30 cm) depending on the amount of temperature drop to be obtained across the depth of the insulation. The blocks are mounted in parquet or checkerboard fashion on the inner wall of a furnace by such means as bolting, stud welding or the like, utilizing mounting brackets mounted on the back of the blocks. Such a parqueting arrangement is shown in FIG. 1. Typical of such block insulations is a system which has proved highly successful in commercial use; the block structure is described in U.S. Pat. No. 4,001,996 to C. O. Byrd, Jr. and the system is commercially available under the trademark Z-BLOK from Johns-Manville Corporation and its licensees.

To date, however, such block insulation systems have found their principal acceptance as insulating liners for gas-fired furnaces rather than for electrically heated furnaces. This is because gas-fired furnaces operate by directing the gas flames through ports in the side of the furnace wall. It has been a simple matter to leave appropriate openings in the fiber block insulation liner through which the gas ports can be extended, as shown in FIG. 1. A cementitious or loose bulk fiber insulation can then be used to fill the space between the gas duct and the next adjacent insulation blocks.

In electrically heated furnaces, however, the electrical heating elements must be mounted on the inside of the furnace and particularly inwardly of the thermal insulation layer. Where the thermal insulation layer is constructed or refractory firebrick or high density rigid refractory fiberboard, specially constructed electrical heating support hangers may be incorporated directly into the rigid wall structure as it is constructed; see, e.g., U.S. Pat. No. 3,987,237. Because of the fundamental differences between the fibrous structures of the insulating blocks (which, as noted, are made from batts and/or blankets of fibers) and the rigid board or brick insulations, however, the systems for electrical heater element support used with the latter have not in practice been adaptable to use with the block insulations.

Two different approaches to providing for electrical heater element supports for fibrous insulation lined furnaces have been described in the prior art. In one system, individual metal hooks for each heater element loop penetrate the fiber and are secured to a metal rod disposed in the fiber body. Such a system is undesirable because each metal hook serves as a heat loss path through the insulation. The portions of the metal rods which protrude from the hot face of the insulation also are susceptible to thermal degradation and act to limit the temperature at which the furnace can be operated unless costly high temperature metal alloys are used for the rods. In the other system, disclosed in U.S. Pat. No. 3,705,253, the fibrous insulation is completely faced with ceramic panels which are secured through the insulation directly to the wall of the furnace. The panels completely cover the hot face of the insulation and have support hooks for the heater elements protruding from the hot face of the panels. This system is undesirable because it requires costly and heavy ceramic panels and because it essentially negates the benefits of the use of fibrous insulation. The ceramic panels suffer all the dificiencies of rigid brick walls (spalling, cracking, high heat capacity, thermal shock susceptibility, etc.) and they block the much more versatile fibrous material from serving as the hot face insulation and thus avoiding such problems.

It is therefore an object of the present invention to provide a system and apparatus such that fiber block insulations can be conveniently and easily used as the predominant thermal insulating liner for electrically heated furnaces.

It is also an object of this invention to provide a system and apparatus for supporting electrical heating element means directly in association with ceramic fiber block insulations.

It is further an object of this invention to provide a system and apparatus in which ceramic fiber insulation and electrical heater element support means are combined into a unitary device.

It is also an object of this invention to provide a system and apparatus in which the principal hot face insulation is fibrous and wherein no metal (other than the heater elements) need be subject to the full furnace temperature.

BRIEF SUMMARY OF THE INVENTION

The invention herein includes a heater element support device to support electrical heater elements and to be used in conjunction with a block of fibrous thermal insulation, which device comprises a bar shaped member having electrical heating element securing means disposed longitudinally along said member and securing means integral with said block to releasably secure said member in a position abutting the hot face of said block. The invention also includes a thermal insulating device which comprises a block of fibrous insulation with abutting the hot face thereof a bar shaped member having electrical heater element securing means disposed longitudinally along said member, said member being releasably secured in position by receiving means integral with said block. The invention further includes such thermal insulating device with electrical heater elements mounted on said member and/or a furnace having a thermal insulating lining comprising said device with the mounted electrical heater elements.

BRIEF DESCRIPTION OF THE DRAWINGS

FIG. 6 illustrates a wall-mounted system, while FIGS. 7 and 8 illustrate systems which may be used for either wall or ceiling mounting.

FIGS. 9 to 13 and 17 are perspective views of several embodiments of element support securing means.

FIG. 14 illustrates in perspective another embodiment of the heater element support of this invention.

FIGS. 15, 16 and 18 are perspective views (the first exploded) of two other embodiments of the heater element support system of this invention.

DETAILED DESCRIPTION OF THE INVENTION

Figure 1:
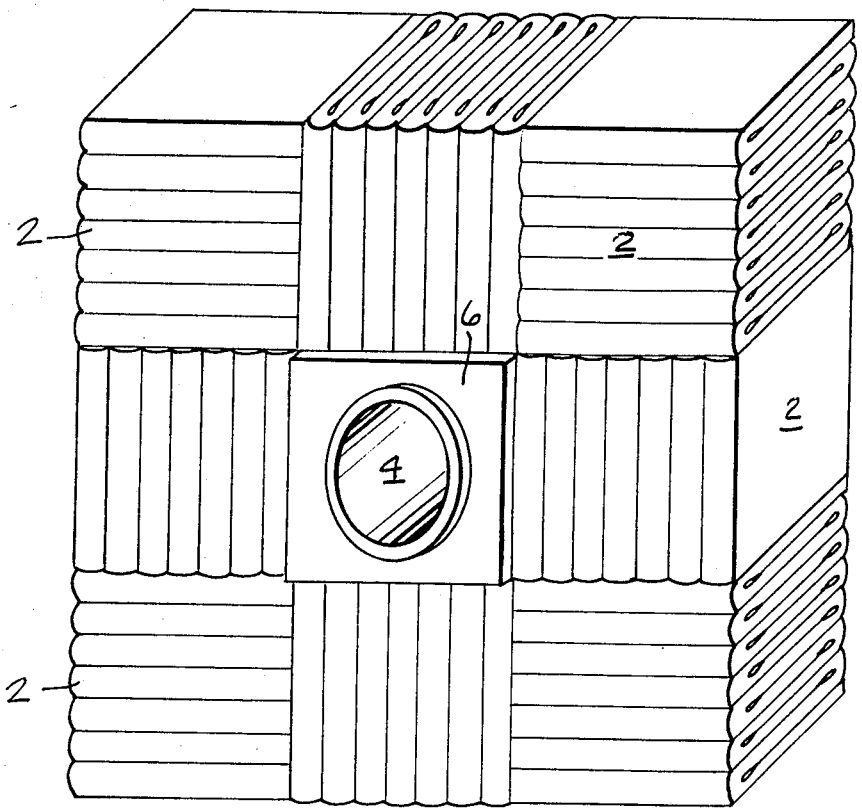
FIG. 1. (PRIOR ART)
FIG. 1 is a perspective view of a portion of a typical prior art refractory fiber block insulation furnace liner for a gas-fired furnace.

The invention herein will be best understood by reference to the drawings. FIG. 1 shows a typical prior art installation in which fiber blocks 2 (sometimes referred to herein as "modules") of the type illustrated in the aforesaid U.S. Pat. No. 4,001,996 are shown arrayed in a parqueted fashion around a gas port 4. An aperture for this gas port is created by forming the parqueted block liner with one block left out at the location of the gas port. Upon completion of the portion of the liner in the vicinity of the gas port, the space between the gas duct and the adjacent blocks 2 (i.e., behind the face plate 6) is then filled with a cementitious or loose bulk fibrous insulation (not shown).

Figure 2:
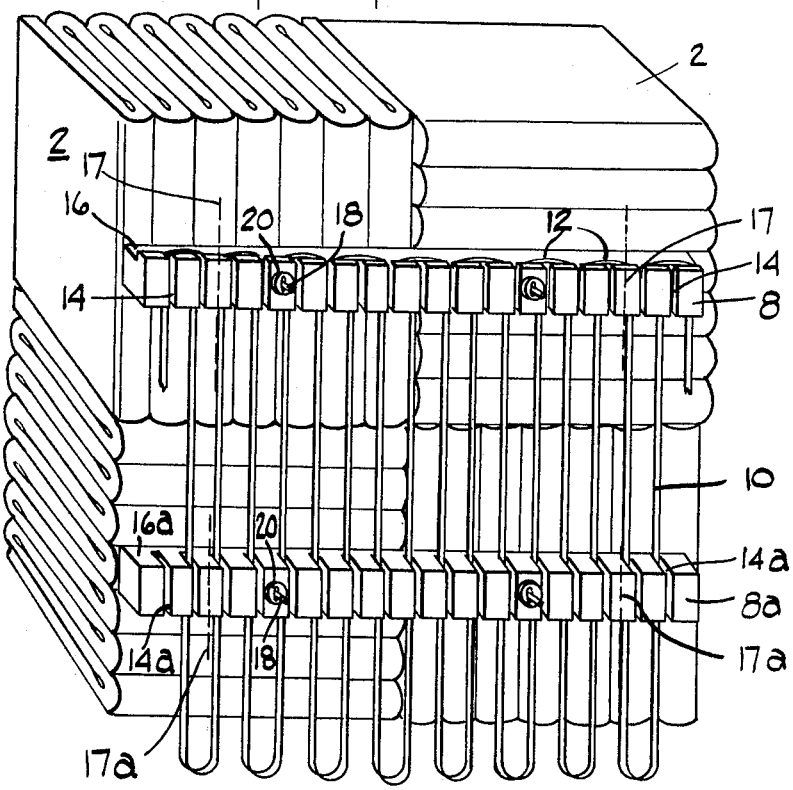
FIG. 2 is a perspective view of a portion of a fiber block insulation furnace liner incorporating means of the present invention for support of electrical heater elements.

In an electrically heated furnace, the same type of parqueting arrangement of the blocks in the liner would be used, with the exception that no apertures in the liner for gas ports would be required. In the present invention at least a portion of the blocks in the liner are fitted with means for supporting electrical heater elements adjacent to the inner surface ("hot face") of the fiber block liner. A portion of such liner so fitted is shown in FIG. 2. In this particular embodiment the blocks are arranged in adjacent horizontal pairs with a single heater element support 8 spanning each pair of blocks. As will be described below, the heater element supports may be constructed in lengths equal to one, two, or more blocks, although for convenience unit lengths of one and two blocks are most preferred. Supported by the heater element support blocks 8 in FIG. 2 is serpentine heater element 10 electrical resistance. The upper loops 12 of the serpentine element 10 are retained in grooves 14 in upper support 8 and rest on the upper surface 16 of the support 8. The lower portions of the heater elements 10 are retained in slots 14*a* in lower support 8*a*. In the particular embodiment shown in FIG. 2 the supports 8 and 8*a* are attached to the blocks 2 by a securing device 18 and retainer 20 (both of which will be described in more detail in conjunction with FIGS. 11 to 13 below).

Figure 3:
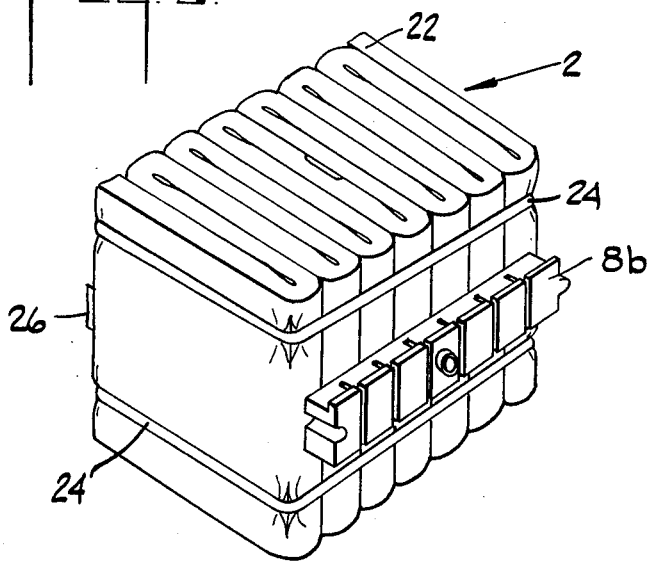
FIG. 3 is a perspective view of an individual fiber block having attached thereto a heater element support in accordance with this invention.

FIG. 3 shows a unitary single block 2 with its associated single unit length support device 8*b* in an embodiment ready for shipping or installation. In this embodiment, the folded fibrous blanket 22 is tightly bound with bands 24 and has a mounting bracket 26 attached to the back surface ("cold face") of the block 2, as described in aforesaid U.S. Pat. No. 4,001,996. Following mounting of the block to the furnace wall with its neighbors in the parquet fashion, bands 24 are cut and removed, allowing the compressed blanket to expand against its adjacent neighbors, thus filling all the spaces between adjacent blocks and presenting a unitary liner hot face which contains essentially no significant heat loss paths.

Figure 4:
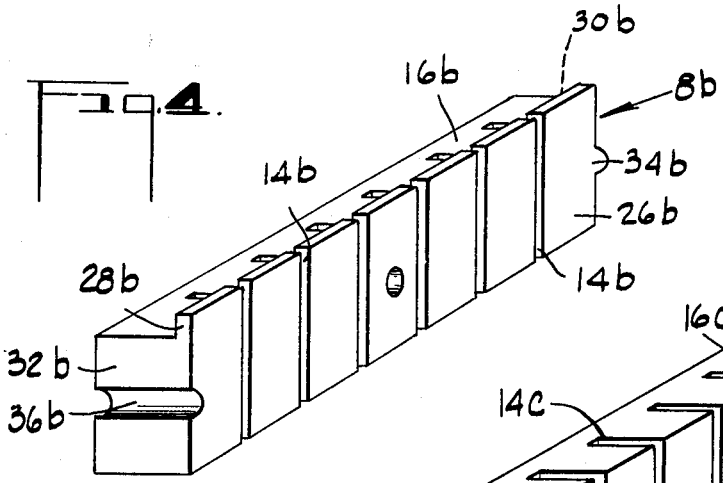
FIGS. 4 and 5 are perspective views of two separate embodiments of heater element supports of the present invention.
Figure 5:
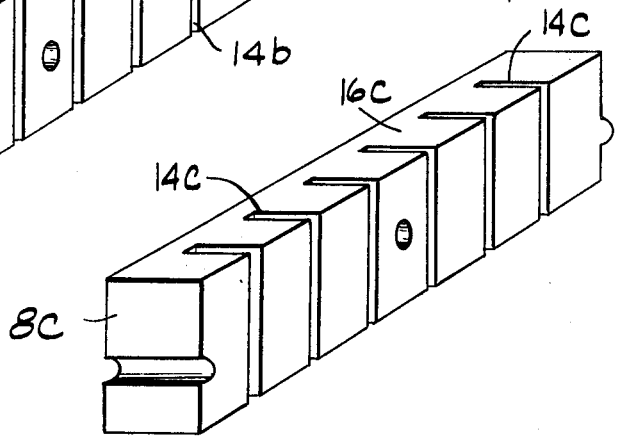

FIGS. 4 and 5 show individual embodiments of the element support means. Illustrated are single block length units, but it will be recognized that (as shown in FIG. 2) support unit lengths of more than one block can be used. Further, when abutting of individual adjacent support members is not necessary or desired, the individual support members need not have lengths equivalent to integral block widths. For instance, in FIG. 2 the supports 8 and 8*a* need not extend to the left and right extremities of the block pair, but could be terminated short of those extremities as at the points indicated by dotted lines 17 and 17*a*.

In the embodiment shown in FIG. 4 the support element 8*b* has a top surface 16*b* and a front surface or hot face 26*b*. The upper portion of hot face 26*b* extends above the surface of top 16*b*, resulting in formation of a narrow restraining lip 28*b* which aids in retaining the upper loops of 12 of heater element 10 in position. At the opposite ends 30*b* and 32*b* of the support member 8*b* are respectively tongue 34*b* and groove 36*b*. These can be utilized to mate with the respective tongues and grooves of adjacent support members to retain the alignment of extended lengths of supports in a furnace. While this tongue and groove arrangement is preferred because it eliminates alignment problems, it is not necessary and if desired the support elements can have simple butt ends as shown in FIG. 2. In the embodiment shown in FIG. 5 the top surface 16*c* of support 8*c* is flat all the way across and has no restraining lip. The heater elements are retained in grooves 14*c* by their weight and frictional engagement with the sides of the grooves. For many types of installations this arrangement provides entirely adequate securement of the heater elements. In addition, the embodiment shown in FIG. 5 has been found to be particularly well suited for use as the lower of a pair of supports, in the manner illustrated in FIG. 2, since ordinarily only lateral restraint of the heater elements is provided by the lower support. The upper support may then be of any desired configuration (as, e.g., the embodiments of FIG. 4 or 14).

The element supports of this invention have substantially the types of shapes shown, in that they have the general shape of a bar with the axial length dimension being significantly greater than either of the width and height dimensions. Typical dimensions of a single block length unit would be a length of 12 inches (30 cm), a height of 3 inches (7 cm) and a width of 1.5 inches (4 cm). Extension to longer lengths will not normally result in substantial changes in the cross-sectional shape or dimensions. The effect of use of supports of the bar shape defined herein is to maximize the amount of fibrous material which comprises the hot face thermal insulation. The problems attendant upon use of ceramic panels have extensive surface areas are therefore eliminated, and essentially the full benefits obtainable from the use of fibrous block insulations are realized.

The fiber blocks of the present invention may be made of any convenient insulating fibers such as glass fiber, aluminosilicate fiber, alumina fiber, silica fiber, rock wool, mineral wool, slag wool, or fibers having an essentially aluminosilicate composition with small amounts of other oxides (such as, e.g., chromia or calcia and magnesia) added. The particular choice of fiber type will depend on the service temperature of the furnace in which the particular block modular lining is to be installed. The support bars 8 will commonly be of ceramic construction, not only for thermal resistance, but also to provide electrical resistance. Metallic support bars could be used if the electrical heater elements are otherwise electrically insulated from the metal support bars and if the particular metal alloy chosen can withstand the hot face service temperature within the furnace.

Figure 7:
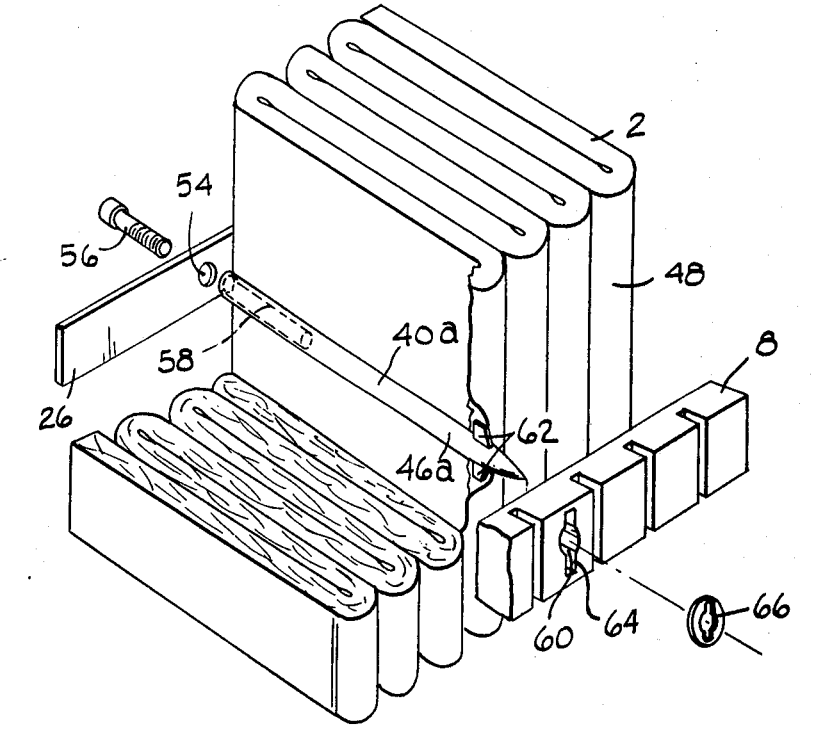
FIGS. 6, 7 and 8 are perspective views, exploded and partly in section, showing different embodiments of the fiber block and heater element support system of the present invention.
Figure 6:
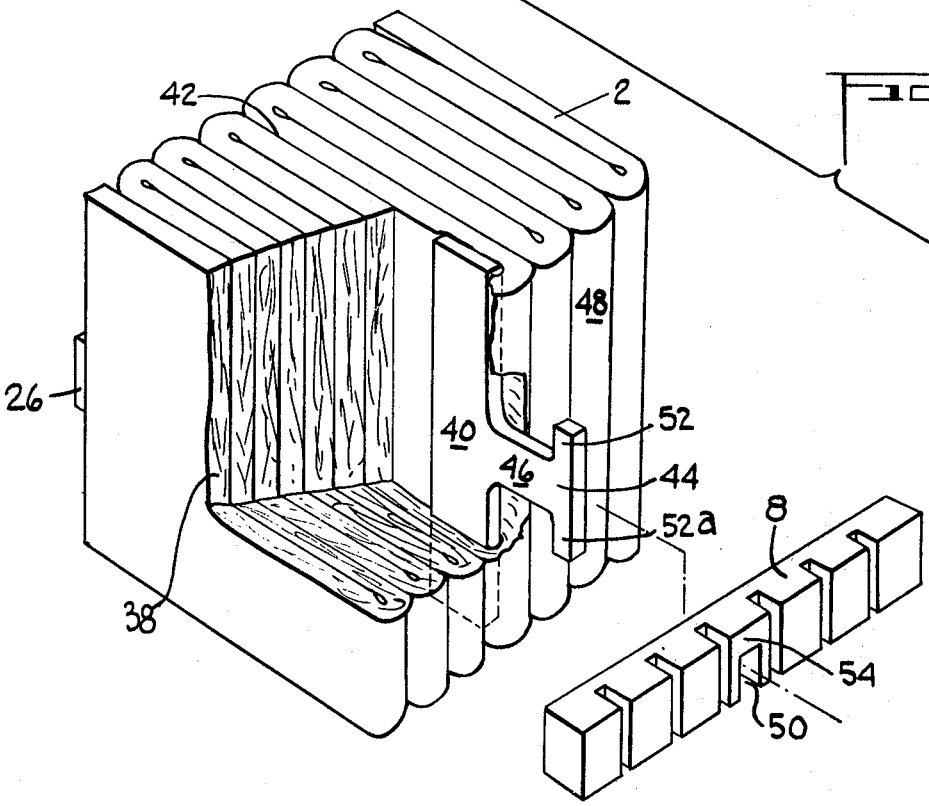
Figure 8:
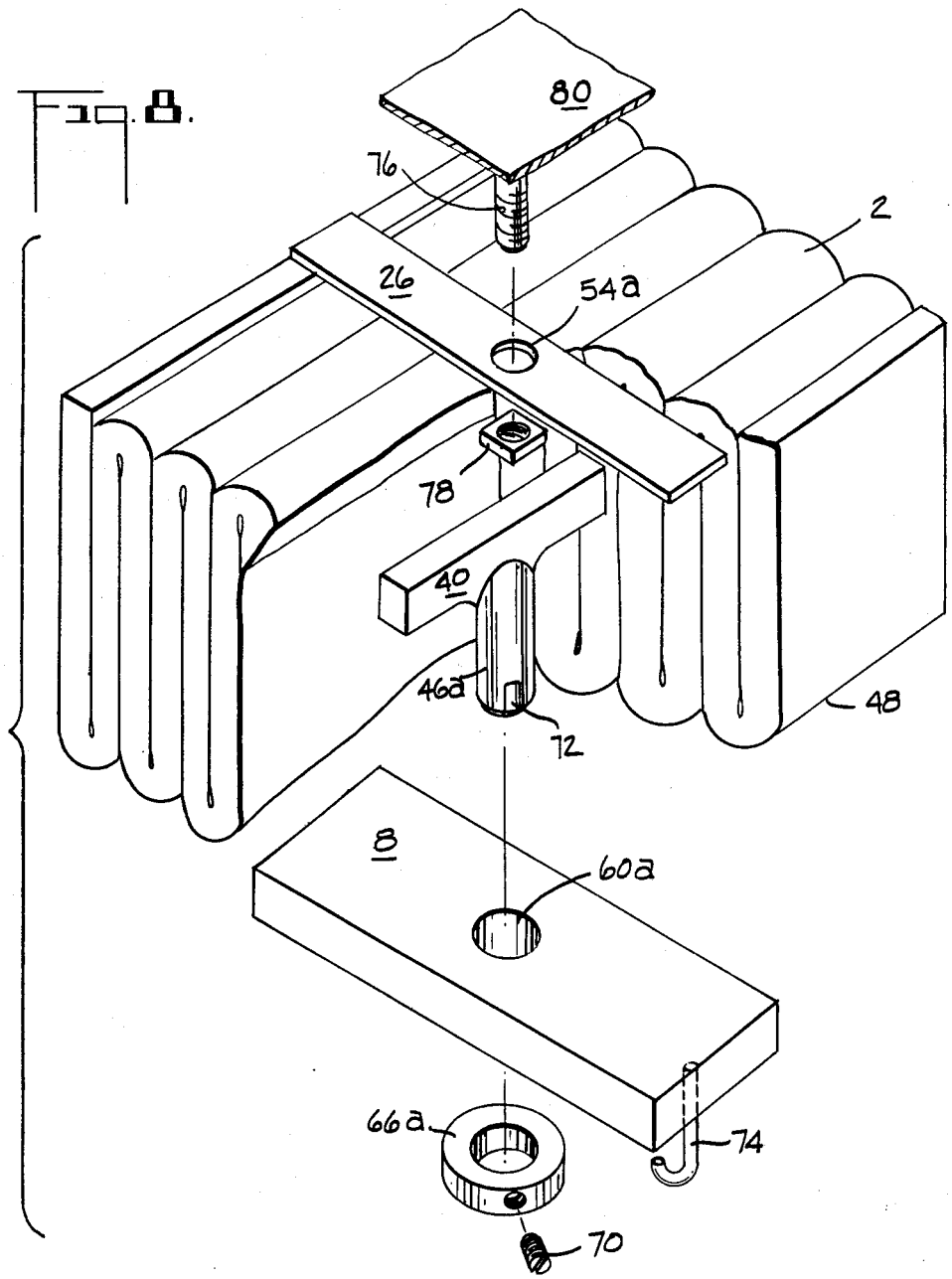
Figure 9:
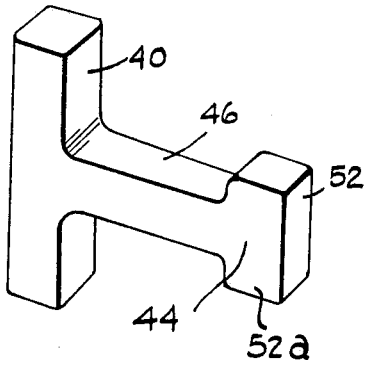

FIGS. 6, 7 and 8 illustrate in detail the structure and operation of three different embodiments of the present invention. FIG. 6 illustrates an embodiment suitable for use as an element in a wall mounted thermal insulation lining, while FIGS. 7 and 8 show embodiments suitable for either wall or ceiling mounting; the embodiment in FIG. 7 is shown in a wall mounted configuration, while the embodiment of FIG. 8 is shown in a ceiling mounted configuration. FIG. 6 shows the modular insulation block 2 cut away at 38 to show an anchoring member 40 embedded in a fold 42 of the modular block 2. In this embodiment the anchoring member 40 is a generally T-shaped structure with the lower portion 44 of the leg 46 of the T being widened; this device is shown in detail in FIG. 9. That portion of leg 46 which extends out of the hot face 48 of the modular block 2 cooperates with a slot 50 in the bottom face of support bar 8 so that the support bar 8 can be mounted against the hot face 48. The upwardly extending part 52 of extended base 44 then cooperates with the front surface 54 of support bar 8 to restrain any tendency of the support bar to move away from its adjacent relationship with the hot face 48 and essentially "locks" support bar 8 in position. It will be noted that in this configuration only portion 52 of base 44 has an operational function, while portion **52*a*, the opposite extended portion of base 44, is non-functional. One could, therefore, if desired, design member 40 to omit portion 52*a*; however, it is preferred that both portions 52 and 52*a* be present to simplify fabrication of the entire block 2 and embedded member 40, since the assembler then need not be concerned with the orientation of member 40 during assembly. The entire assembled modular unit block 2 is attached to a wall structure (not shown) by means of attaching element 26**.

Figure 11:
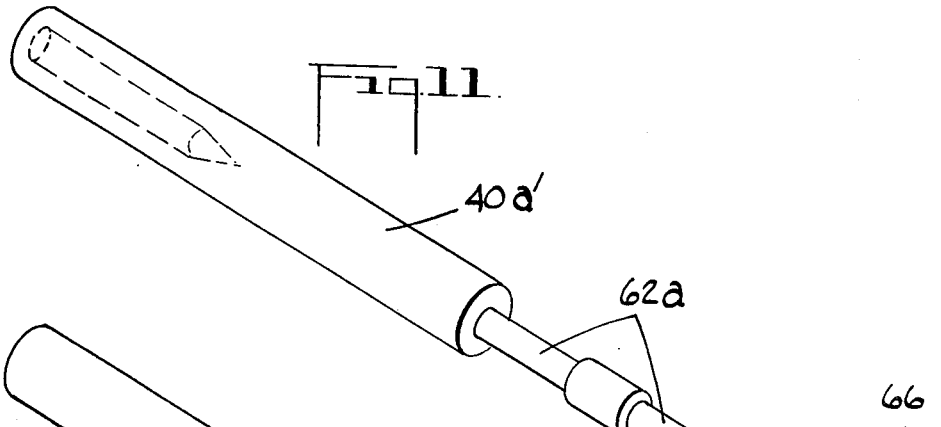
Figure 12:
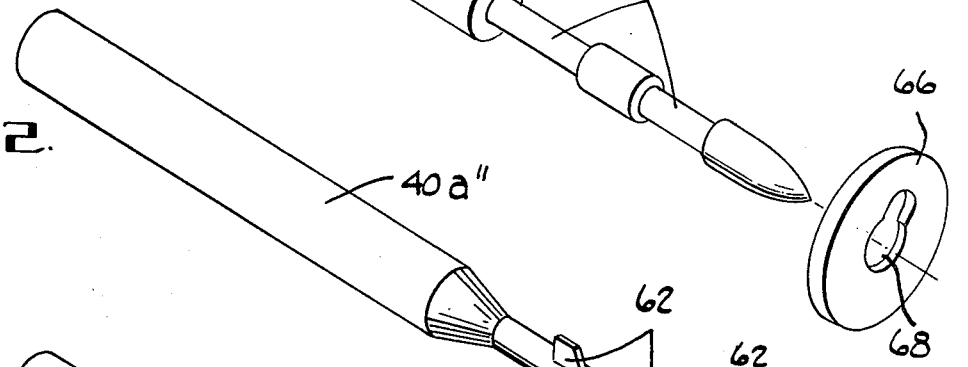
Figure 13:
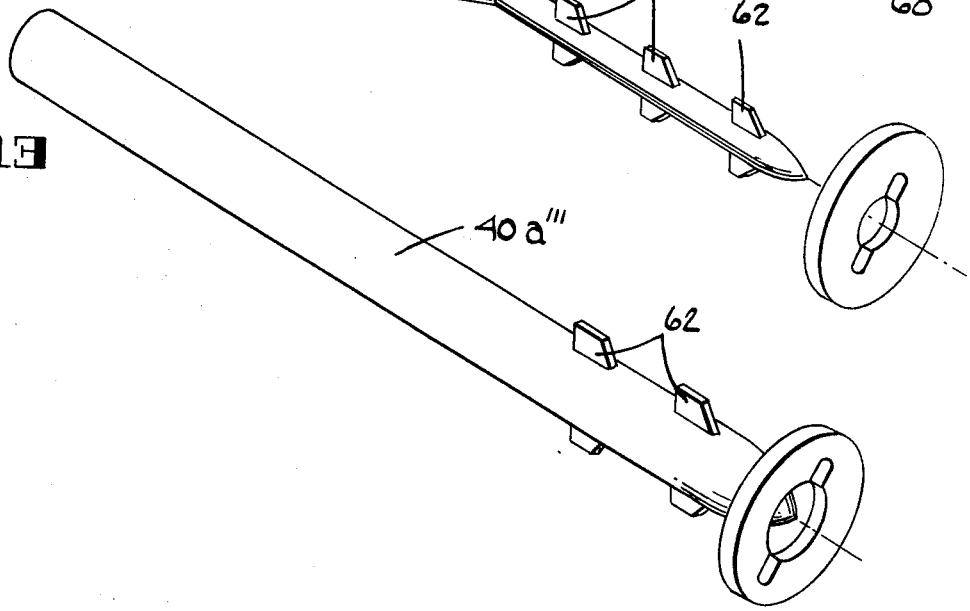
Figure 19:
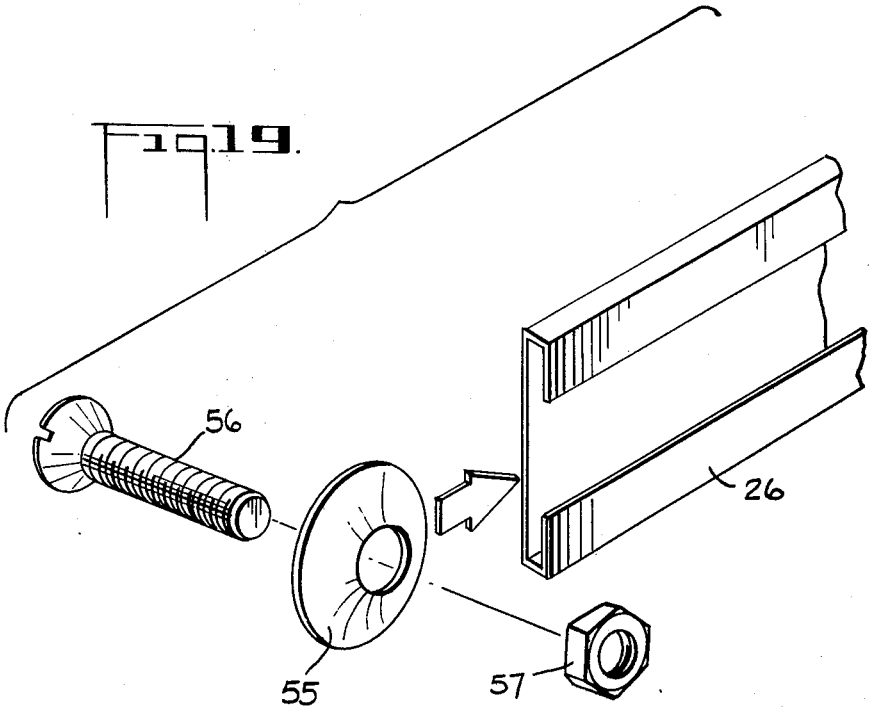
FIG. 19 illustrates in perspective one means of securing the anchoring member to the block attaching element.

In FIG. 7 the modular block 2 has mounted thereon attaching element 26 which has therein a hole 54, normally centrally located. Mounting screw 56 extends through hole 54 into the anchoring member 40 which in this embodiment is an elongated pin designated **40*a*. Alternatively, attaching element 26 may have a channel shape and mounting screw 56 may be secured thereto by tapered washer 55 and nut 57, as shown in FIG. 19. The pin 40*a* has a recess 58 in its base to engage screw 56. A portion 46*a* of the pin 40*a* extends out of the hot face 48 of block 2 and passes through a hole 60 in support bar 8. In the embodiment shown, pin 40*a* has near the outward end thereof lugs 62 which pass through slots 64 which are a part of hole 60 and which serve to engage washer 66 to form a typical bayonet connection. A pin of this type with its bayonet connection used to secure batts of insulation to a furnace wall is shown in U.S. Pat. No. 3,523,395. Other suitable structures for pin 40*a* include those shown as devices 40*a*', 40*a*'' and 40*a*''' in FIGS. 11, 12 and 13. In FIG. 11 the single pair of lugs 62 are replaced by recessed portions 62*a*, each of which is designed to engage in a washer 66 with an appropriately shaped aperture 68; a pin and washer of this type for use in anchoring batts of insulation are shown in U.S. Pat. No. 4,018,023. The pin embodiments shown in FIGS. 12 and 13 are generally similar to that shown in FIG. 7. The configuration in FIG. 13 has a plurality of pairs of lugs 62 arranged axially of the pin to provide the flexibility to accommodate support bars of different thicknesses. The configuration in FIG. 12 is generally similar to that shown in FIG. 7 except that the terminal portion of the shaft of the pin is reduced in diameter so that the lugs 62 project outwardly to essentially the same diameter as the thicker portion of the shaft, similar in manner to the pin shown in U.S. Pat. No. 3,738,217. This type of configuration reduces the size of the hole made in the block 2 as the pin is pushed through it during assembly. For the present invention, however, it has the disadvantage that the portion of the pin with the smallest diameter engages the support 8**. Thus the full weight of the support and the electrical heater elements is applied to the weakest portion of the pin, and the weight effect is compounded by the cantilevered nature of the pin structure.

It will be evident that the various pins shown in FIGS. 7, 11, 12 and 13 need not be circular in cross-section, but may if desired have square, rectangular, or other cross-sectional configurations. Further, they need not be mounted with screws such as shown in FIG. 7 but may use other types of attachment to attaching element 26 means such as direct stud welding of the pin to element 26 or a bracket arrangement such as is shown in the aforesaid U.S. Pat. No. 4,018,023.

Figure 10:
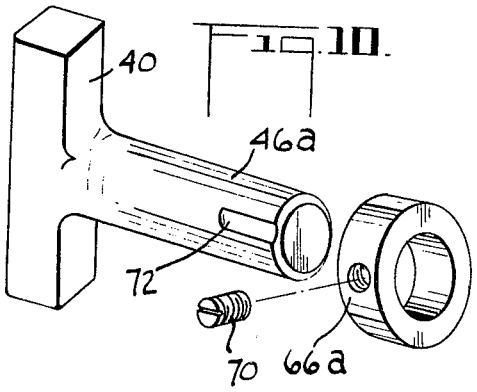

The embodiment shown in FIG. 8 is illustrated as a ceiling mounted unit. The anchoring member 40 in this embodiment is T-shaped, but has a rounded leg **46*a*, and is shown in detail in FIG. 10. This leg extends from the hot surface 48 through a hole 60*a* in support bar 8 and engages washer 66*a*. Washer 66*a* has a set screw 70 which engages a flat surface 72 on leg 46*a* to lock the support bar in position. Alternatively, flat surface 72 can be substituted by a hole into which set screw 70 will fit. Other configurations, such as a threaded washer fitting onto a threaded end of base 42*a*** will be immediately evident to those skilled in the art.

Hybrids of the various types of anchoring members shown in FIGS. 9 to 13 may also be used. An example is shown in FIG. 17 which combines the T configuration of the member 40 of FIG. 10 with the pin end configuration of the member **40*a*' of FIG. 11**. Other combinations will be evident.

It will be noted in FIG. 8 that support bar 8 is not fitted with slots such as shown in FIG. 6 or 7, but rather is fitted with downwardly facing hooks 74 from which the heater elements are to be suspended. Other attaching means than hooks will also be readily apparent.

The ceiling support system used to mount modular block 2 in FIG. 8 comprises the attaching element 26 which contains hole **54*a*, normally centrally located. Stud 76 is attached to ceiling segment 80 and projects through hole 54*a* and is secured with nut 78**.

The various attaching devices 40 will normally be constructed of ceramic material for thermal resistance.

High temperature metal alloys may be used but are not normally desirable because of their tendency to conduct heat away from the hot face of the insulation.

FIG. 14 illustrates a two-part support member 8*d*. The cold face portion 80 consists of a flat base 82 with a plurality of cylindrically shaped pegs 84 protruding inwardly therefrom and being substantially equally spaced. The length of the pegs is chosen as slightly greater than the thickness of the heater element so that when the two-part member 8*d* is assembled, the heater element coils or loops can be retained therein. Base 82 will contain one or more holes 86 (which may pass through pegs 84 as shown at 86'). These holes 86 will align with holes 88 in cover plate 90. Cover plate 90 has essentially the same configuration as base 82. Anchoring members (here shown as members 40*a*' from FIG. 11) pass through holes 86 and 88 and secure cover plate 90 tightly against the ends of pegs 84 by means such as washers 66 (also from FIG. 11).

Figure 18:
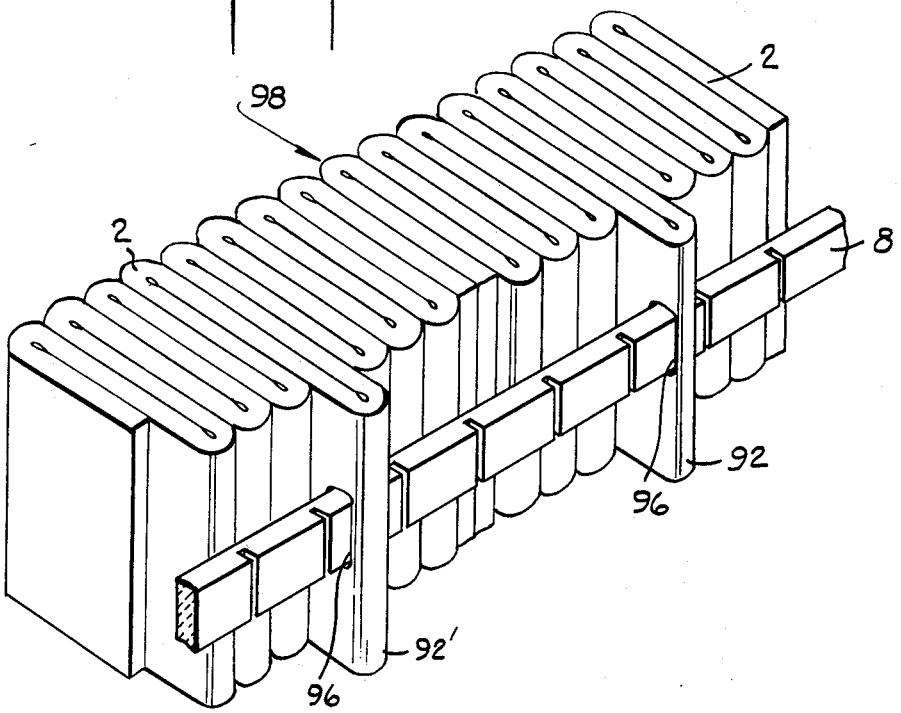

FIGS. 15, 16 and 18 show yet other embodiments of the present invention, in which the block 2 itself is configured to support the support member 8. In the embodiment shown in FIGS. 15 and 16, folds 92 of block 2 are extended out of the hot face of the block and then are grooved at the top as at 94. The support member 8 then fits into groove 94 as shown in FIG. 16. Blocks disposed above or below the block shown would have other support members similarly supported; these could be configured as desired, as in FIG. 4 or 5. In FIGS. 15 and 16 alternating folds are shown extended, but it will be evident that the folds to be extended can be chosen as convenient, as, e.g., every third or fourth fold, or the folds at each end, etc.

The embodiment in FIG. 18 is similar to that of FIGS. 15 and 16, except that instead of a groove 94, each extended fold 92' has a hole 96 cut in it, in which the support member 8 rests. In the embodiment as shown, two blocks 2 each with one extended fold 92' and abutting at 98 are shown. However, a single block with at least two extended folds could also be used. Also the two blocks shown could be separated at 98 by one or more blocks with or without extended folds with holes 96 so that support member 8 would extend across several blocks.

STATEMENT OF INDUSTRIAL APPLICATION

The invention herein is useful in industrial applications which require a thermally insulating lining on the inside of electrically heated chambers such as furnaces and kilns. It has particular application to industries in which materials such as glass or metal are annealed in furnaces, or in industries where pottery or other ceramic materials are to be fired or annealed in furnaces.

I claim:

1. A heater element support device to support electrical heater elements and to be used in conjunction with a block of fibrous thermal insulation which is adapted to be secured to a wall of a heated chamber by means of an attaching element attached to the cold face of said block, which device comprises:

(a) a bar shaped member having heater element securing means disposed longitudinally along said member; and (b) member securing means integral with said block and penetrating the hot face of said block at only a single location to releasably secure said member in a position abutting said hot face of said block.

2. A device as in claim 1 wherein said heater element securing means comprises a plurality of slots cut into said member.

3. A device as in claim 2 wherein said member also comprises a restraining lip projecting above the top surface of said member and aligned with the hot face of said member.

4. A device as in claims 1, 2 or 3 wherein said member has a length essentially equal to a unit width of one said block or an integer multiple thereof.

5. A device as in claims 1, 2 or 3 wherein said member is fitted at its opposite ends with tongue and groove structures respectively.

6. A device as in claims 1, 2 or 3 wherein said member securing means is attached directly to the attaching element of said block.

7. A device as in claim 6 wherein said member securing means comprises a pin attached to the attaching element of said block and projecting through said block and said member and securing said member with cooperating retainer means.

8. A device as in claim 7 wherein said pin has lugs near the end thereof and said retainer means engages said lugs to form a bayonet connection.

9. A device as in claim 7 wherein said pin has a circumferential recess in the shaft thereof and said retainer means has a hole therein which engages said recess to form a connection.

10. A device as in claims 1, 2 or 3 wherein said member securing means has a portion embedded in said block and another portion extending out of the hot face of said block.

11. A device as in claim 10 wherein said member securing means comprises a generally T-shaped device which is embedded in said block and of which a portion protrudes out of said block and through said member, said member securing means having associated therewith retainer means to secure said member to the hot face of said block.

12. A device as in claim 11 wherein said retainer means comprises a projection at the end of said protruding portion which projection engages the hot face of said member.

13. A device as in claim 11 wherein said retainer means comprises a retaining ring which engages the outer end of said protruding portion and is secured thereto.

14. A heater element support device to support electrical heater elements and to be used in conjunction with a block of fibrous thermal insulation which is adapted to be secured to a wall of a heated chamber by means of an attaching element attached to the cold face of said block, which device comprises:

(a) a bar shaped member having heater element securing means disposed longitudinally along said member; and (b) member securing means integral with said block to releasably secure said member in a position abutting the hot face of said block, said member securing means comprising at least one recess incorporated into a portion of said block to receive said member in a position adjacent to the hot face of said block.

15. A device as in claim 14 wherein said block contains at least one fold extending inwardly from the hot face thereof and said recess is in said at least one fold.

16. A device as in claim 15 wherein said recess comprises a groove in the top of the extended portion of said at least one fold.

17. A device as in claim 15 wherein said recess comprises a hole through the side of the extended portion of said at least one fold.

18. A thermal insulating device which comprises a block of fibrous insulation which is adapted to be secured to a wall of a heated chamber by means of an attaching element attached to the cold face of said block and which has abutting the hot face of said block a bar shaped member having electrical heater element means disposed longitudinally along said member, said member being releasably secured in position by member securing means integral with said block and penetrating said hot face of said block at only a single location.

19. A device as in claim 18 wherein there is present electrical heater element securing means comprising a plurality of slots cut into said member.

20. A device as in claim 19 wherein said member also comprises a restraining lip projecting above the top surface of said member and aligned with the hot face of said member.

21. A device as in claims 18, 19 or 20 wherein said member has a length essentially equal to a unit width of one said block or an integer multiple thereof.

22. A device as in claims 18, 19 or 20 wherein said member is fitted at its opposite ends with tongue and groove structures respectively.

23. A device as in claims 18, 19 or 20 wherein said member securing means comprises a pin attached to the attaching element of said block and projecting through said block and said member and securing said member with cooperating retainer means.

24. A device as in claim 23 wherein said pin has lugs near the end thereof and said retainer means engages said lugs to form a bayonet connection.

25. A device as in claim 23 wherein said pin has a circumferential recess in the shaft thereof and said retainer means has a hole therein which engages said recess to form a connection.

26. A device as in claims 18, 19 or 20 wherein said member securing means comprises a generally T-shaped device which is embedded in said block and of which a portion protrudes out of said block and through said member, said member securing means having associated therewith retainer means to secure said member to the hot face of said block.

27. A device as in claim 26 wherein said retainer means comprises a projection at the end of said protruding portion which projection engages the hot face of said member.

28. A device as in claim 26 wherein said retainer means comprises a retaining ring which engages the outer end of said protruding portion and is secured thereto.

29. A device as in claims 18, 19 or 20 having electrical heater elements mounted on said member.

30. A heater element support device to support electrical heater elements and to be used in conjunction with a block of fibrous thermal insulation which is adapted to be secured to a wall of a heated chamber by means of an attaching element attached to the cold face of said block, which device comprises:

(a) a bar shaped member having heater element securing means disposed longitudinally along said member; and (b) member securing means integral with said block to releasably secure said member in a position abutting the hot face of said block, said member securing means comprising at least one recess incorporated into a portion of said block to receive said member in a position adjacent to the hot face of said block.

31. A device as in claim 30 wherein said block contains at least one fold extending inwardly from the hot face thereof and said recess is in said at least one fold.

32. A device as in claim 31 wherein said recess comprises a groove in the top of the extended portion of said at least one fold.

33. A device as in claim 31 wherein said recess comprises a hole through the side of the extended portion of said at least one fold.

34. A furnace having a thermally insulating lining comprising the device of claims 1, 14, 18 or 31.

* * * * *